US009095490B2

(12) United States Patent
Ma

(10) Patent No.: US 9,095,490 B2
(45) Date of Patent: Aug. 4, 2015

(54) PALM MASSAGER

(75) Inventor: Xuejun Ma, Shenzhen (CN)

(73) Assignee: SHENZHEN BREO TECHNOLOGY CO., LTD., Shenzhen, Guangdong (CN)

( * ) Notice: Subject to any disclaimer, the term of this patent is extended or adjusted under 35 U.S.C. 154(b) by 582 days.

(21) Appl. No.: 13/508,278

(22) PCT Filed: Apr. 26, 2011

(86) PCT No.: PCT/CN2011/073294

§ 371 (c)(1),
(2), (4) Date: May 4, 2012

(87) PCT Pub. No.: WO2012/100467

PCT Pub. Date: Aug. 2, 2012

(65) Prior Publication Data

US 2013/0018292 A1 Jan. 17, 2013

(30) Foreign Application Priority Data

Jan. 24, 2011 (CN) ..... 2011 2 0022428 U

(51) Int. Cl.
*A61H 9/00* (2006.01)

(52) U.S. Cl.
CPC ..... *A61H 9/0078* (2013.01); *A61H 2201/165* (2013.01); *A61H 2201/5038* (2013.01); *A61H 2205/065* (2013.01)

(58) Field of Classification Search
CPC ..... A61H 9/0078; A61H 2205/065; A61H 2201/5038; A61H 2201/165
USPC ..... 601/148, 149, 150, 151, 152; 602/13; 128/DIG. 20
See application file for complete search history.

(56) References Cited

U.S. PATENT DOCUMENTS

| | | | | |
|---|---|---|---|---|
| 6,171,270 | B1 * | 1/2001 | Gau | 601/150 |
| 2005/0154336 | A1 * | 7/2005 | Kloecker et al. | 601/148 |
| 2009/0227914 | A1 * | 9/2009 | Kanaoka | 601/150 |
| 2009/0240179 | A1 * | 9/2009 | Nakao et al. | 601/152 |

* cited by examiner

*Primary Examiner* — Quang D Thanh
(74) *Attorney, Agent, or Firm* — Rankin, Hill & Clark LLP

(57) ABSTRACT

The present invention relates to a massage device, and provides a palm massager comprising a plurality of air bags corresponding to each part of the palm, an air pump, a plurality of electromagnetic valves for controlling the air charging and air discharging of the plurality of air bags, a main control module and a plurality of load driving modules. The palm massager according to this invention includes a plurality of air bags corresponding to each part of the palm, an air pump, a plurality of electromagnetic valves for controlling the air charging and air discharging of the plurality of air bags and a main control module, by controlling the air charging and air discharging of the air bags by means of the plurality of electromagnetic valves controlled by the main control module, the massage on each part of the palm can be carried out, and the massage on each part of the palm with various strength and at different time can be achieved, thus the massage in this way confirms to the massage principle of the traditional Chinese medicine, and may promote the blood circulation of the palm better.

2 Claims, 2 Drawing Sheets

PALM MASSAGER

TECHNICAL FIELD

The present invention relates to a massage device, and more particularly, to a palm massager.

BACKGROUND

Palm massager is a new generation of health care equipment designed based on physics, bionics, electrobiology, traditional Chinese medicine and developed with many years of clinical practice.

Palm massager can make the user relax muscles, soothe nerves, promote blood circulation, improve cell metabolism and enhance skin elasticity, and has the functions of relieving fatigue, alleviating all kinds of chronic pain, acute pain and muscle soreness significantly, relaxing the body part, relieving stress, reducing wrinkles and the like.

All of the existing palm massagers take an overall massage manner when give a massage on the palm, that is, each part of the palm are massaged with the same strength simultaneously. Such massage mode is not very good for the recirculation of blood in the palm, on the other hand, the single massage manner employed in the existing palm massager does not confirm to the massage principle of the traditional Chinese medicine, as a result, the palm cannot get better massage and health care.

SUMMARY

The object of the present invention is to provide a palm massager, and to provide a solution to the problem of poor effect of the overall massage manner in exiting palm massagers.

The above-mentioned technical problems can be solved through the following technical solutions: a palm massager includes:

a plurality of control keys for controlling the strength of massage, the manner of massage and the duration of massage separately;

a plurality of air bags corresponding to each part of the palm; an air pump;

a plurality of electromagnetic valves arranged between the plurality of air bags and the air pump and for controlling the air charging and air discharging of the plurality of air bags respectively;

a main control module coupled with the plurality of control keys; and a plurality of load driving modules for driving the air pump and the plurality of electromagnetic valves respectively under the control signal of the main control module, and arranged between the main control module and the air pump and between the main control module and the plurality of electromagnetic valves.

In one embodiment of the present invention, the main control module is an MCU comprising a plurality of input and output ports, wherein the plurality of input ports are connected with a plurality of control keys respectively and the plurality of output ports are connected with a plurality of load driving modules respectively.

In one embodiment of the present invention, the load driving module includes:

a resistor R1, a diode D1, a diode D2, a capacitor C1 and a triode Q1; wherein a first terminal of the resistor R1 is connected to an output port of the MCU, and a second terminal of the resistor R1 is connected to the anode of the diode D1, and the cathode of the diode D1 is connected to the base of the triode Q1, and the emitter of the triode Q1 is grounded, and a collector of the triode Q1 is connected to a cathode of the air pump or a cathode of the electromagnetic valve, and the diode D2 and the capacitor C1 are connected in parallel and arranged between a power supply and the collector of the triode Q1.

The palm massager according to this invention includes a plurality of air bags corresponding to each part of the palm, a plurality of electromagnetic valves for controlling the air charging and air discharging of the plurality of air bags and a main control module for controlling the plurality of electromagnetic valves. By controlling the air charging and air discharging of the air bags by means of the plurality of electromagnetic valves controlled by the main control module, the massage on each part of the palm can be carried out, and the massage on each part of the palm with different strength and at different time can be achieved. The massage in this way confirms to the massage principle of the traditional Chinese medicine, and may promote the blood circulation of the palm better.

DETAILED DESCRIPTION OF THE PREFERRED EMBODIMENTS

Objects, technical scheme and advantages of the present invention will be explained below in detail with reference to the accompanying drawings and the embodiments. However, it is to be appreciated that the following description of the embodiments is merely exemplary in nature and is not intended to limit the invention.

A palm massager includes:

a plurality of control keys for controlling the strength of massage, the manner of massage and the duration of massage separately;

a plurality of air bags corresponding to each part of the palm;

an air pump;

a plurality of electromagnetic valves for controlling the air charging and air discharging of the plurality of air bags respectively, wherein the plurality of electromagnetic valves are arranged between the plurality of air bags and the air pump;

a main control module coupled with the plurality of control keys; and a plurality of load driving modules for driving the air pump and the plurality of electromagnetic valves respectively under the control signal of the main control module, wherein the plurality of load driving modules are arranged between the main control module and the air pump and between the main control module and the plurality of electromagnetic valves.

In one embodiment of the present invention, the main control module is an MCU including a plurality of input and output ports, wherein the plurality of input ports are connected with a plurality of control keys respectively and the plurality of output ports are connected with a plurality of load driving modules respectively.

The structure of the palm massager according to one embodiment of the invention including two air bags, one air pump and three load driving modules will be illustrated below.

Figure 1:
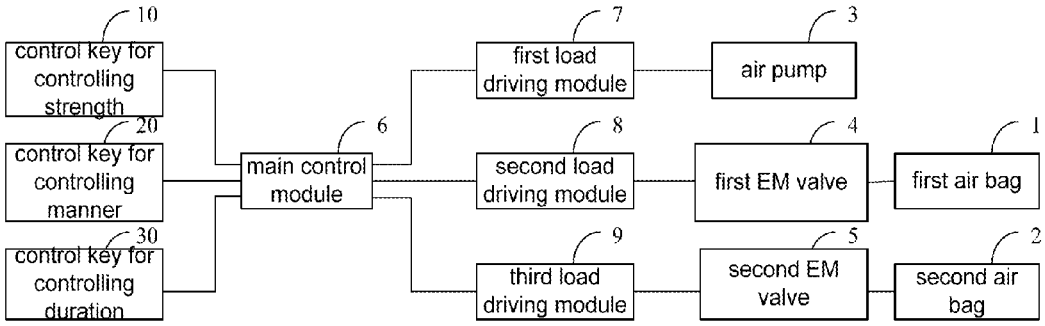
FIG. 1 is a module structural drawing of a palm massager in accordance with an embodiment of the present invention.

FIG. 1 is a module structural drawing of a palm massager in accordance with an embodiment of the present invention, and only the parts relating to the embodiments in according to the present invention are shown for the convenience of illustration.

A palm massager comprises:

a control key 10 for controlling the strength of massage, a control key 20 for controlling the manner of massage, a control key 30 for controlling the duration of massage;

a first air bag 1 and a second air bag 2 corresponding to the left and right parts of the palm respectively;

an air pump 3;

a first electromagnetic valve 4 and a second electromagnetic valve 5 for controlling the air charging and air discharging of the first air bag 1 and the second air bag 2 respectively, wherein the first electromagnetic valve 4 is arranged between the first air bag 1 and the air pump 3, and the second electromagnetic valve 5 is arranged between the second air bag 2 and the air pump 3;

a main control module 6 coupled with the control key 10 for controlling the strength of massage, the control key 20 for controlling the manner of massage and the control key 30 for controlling the duration of massage simultaneously; and a first load driving module 7 for driving the air pump 3, a second load driving module 8 for driving the first electromagnetic valve 4 and a third load driving module 9 for driving the second electromagnetic valve 5.

Figure 2:
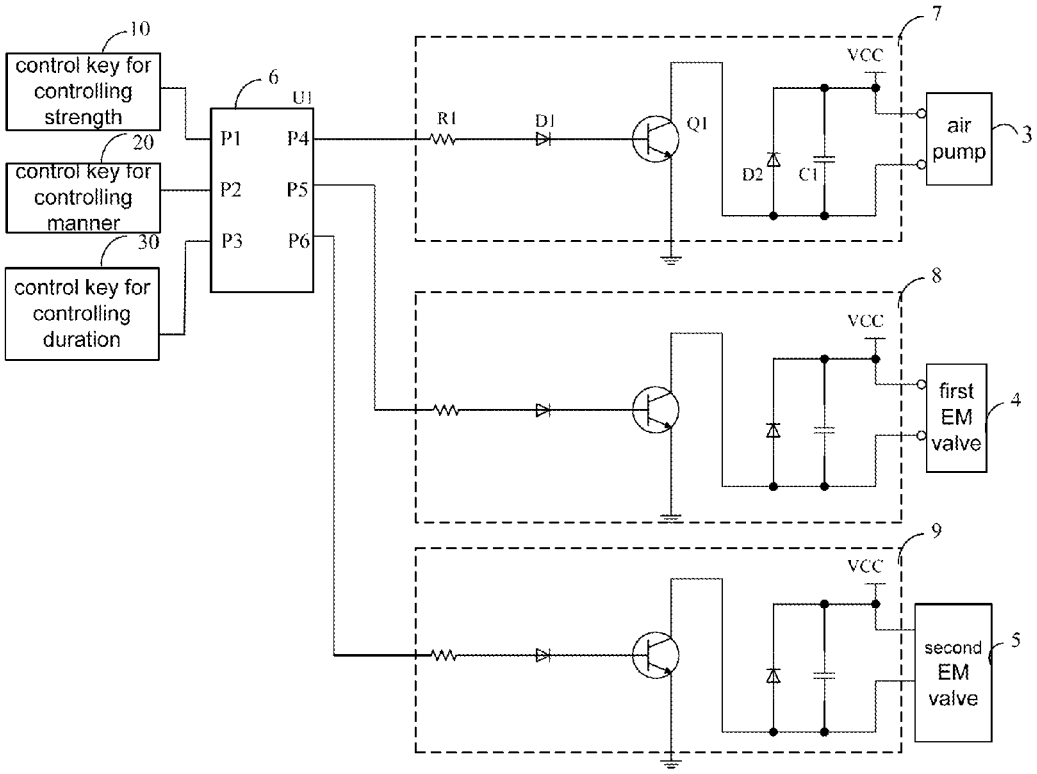
FIG. 2 is a circuit diagram of a palm massager in accordance with an embodiment of the present invention.

FIG. 2 shows the circuit structure of a palm massager in accordance with an embodiment of the present invention, and only the parts relating to the embodiments in according to the present invention are shown for the convenience of illustration.

In one example of the invention, the main control module 6 is an MCU U1 comprising a first input port P1, a second input port P2, a third input port P3, a first output port P4, a second output port P5 and a third output port P6, wherein the first input port P1, the second input port P2 and the third input port P3 are connected to a control key 10 for controlling the strength of massage, a control key 20 for controlling the manner of massage and a control key 30 for controlling the duration of massage respectively, and the first output port P4, the second output port P5 and the third output port P6 are connected to a first load driving module 7, a second load driving module 8 and a third load driving module 9 respectively.

In one example of the invention, the first load driving module 7 includes:

a resistor R1, a diode D1, a diode D2, a capacitor C1 and a triode Q1, wherein a first terminal of the resistor R1 is connected to the first output port P4 of the MCU U1, a second terminal of the resistor R1 is connected to the anode of the diode D1, the cathode of the diode D1 is connected to the base of the triode Q1, the emitter of the triode Q1 is grounded, the collector of the triode Q1 is connected to the cathode of the air pump 3, and the diode D2 and the capacitor C1 are connected in parallel and arranged between the power supply VCC and the collector of the triode Q1.

Only the structure of the first load driving module 7 is hereby illustrated and the details of the structures of the second load driving module 8 and the third load driving module 9 will not be given because the structures of the second load driving module 8 and the third load driving module 9 are both the same as that of the first load driving module 7.

Operational principle of the palm massager is set forth below.

According to the operating informations from the control key 10 for controlling the strength of massage, the control key 20 for controlling the manner of massage and the control key 30 for controlling the duration of massage, the MCU U1 sends corresponding control signals to the first load driving module 7 for driving the air pump 3, to the second load driving module 8 for driving the first electromagnetic valve 4 and to the third load driving module 9 for driving the second electromagnetic valve 5 separately.

For example, after receiving the control signal from the control key 20 for controlling the manner of massage, the MCU U1 will choose to drive the first electromagnetic valve 4 or the second electromagnetic valve 5 work, so as to give a massage on the left part or the right part or both the left and right parts of the palm by controlling the palm massager; after receiving the control signal from the control key 10 for controlling the strength of massage, the MCU U1 will choose to drive the air pump 3 and the first electromagnetic valve 4 or the second electromagnetic valve 5 work, so as to control the strength of massage when give a massage on the palm; after receiving the control information from the control key 30 for controlling the duration of massage, the MCU U1 will choose to drive the air pump 3 and the first electromagnetic valve 4 or the second electromagnetic valve 5 work, so as to control the duration of massage when give a massage on the palm.

The palm massager of the present invention includes a plurality of air bags corresponding to each part of the palm, a plurality of electromagnetic valves for controlling the air charging and air discharging of the plurality of air bags separately and a main control module for controlling the operations of the plurality of electromagnetic valves. By controlling the air charging and air discharging of the air bags by means of the plurality of electromagnetic valves controlled by the main control module, the massage on each part of the palm can be carried out, and the massage on each part of the palm with different strength and at different time can be achieved. The massage in this way confirms to the massage principle of the traditional Chinese medicine, and may promote the blood circulation of the palm better.

The embodiments above are merely the preferable embodiments of the present invention and not intended to limit the present invention. And all changes, equivalent substitution and improvements which come within the meaning and range of equivalency of the present invention are intended to be embraced therein.

What is claimed is:

1. A palm massager comprising:

a plurality of control keys for controlling strength of massage, pattern of massage and duration of massage separately;

a plurality of air bags configured to contact each part of a palm;

an air pump;

a plurality of electromagnetic valves arranged between the plurality of air bags and the air pump and for controlling air charging and air discharging of the plurality of air bags respectively;

a main control module coupled with the plurality of control keys; and a plurality of load driving modules for driving the air pump and the plurality of electromagnetic valves respectively under a control signal of the main control module, and arranged between the main control module and the air pump and between the main control module and the plurality of electromagnetic valves, wherein the load driving module each comprises a resistor R1, a diode D1, a diode D2, a capacitor C1 and a triode Q1;

wherein a first terminal of the resistor R1 is connected to an output port of a micro controller unit, a second terminal of the resistor R1 is connected to an anode of the diode D1, a cathode of the diode D1 is connected to a base of the triode Q1, an emitter of the triode Q1 is grounded, a collector of the triode Q1 is connected to a cathode of the air pump or a cathode of the electromagnetic valve, and the diode D2 and the capacitor C1 are connected in parallel and arranged between a power supply and the collector of the triode Q1.

2. The palm massager as claimed in claim 1, wherein the main control module is a micro controller unit comprising a plurality of input and output ports, the plurality of input ports are connected with a plurality of control keys respectively and the plurality of output ports are connected with a plurality of load driving modules respectively.

* * * * *